US011284209B1

(12) United States Patent
Sha et al.

(10) Patent No.: US 11,284,209 B1
(45) Date of Patent: Mar. 22, 2022

(54) INTERNALLY WELDED ANC BLUETOOTH HEADSET SPEAKER

(71) Applicant: DONGGUAN WANTAI ELECTRONICS TECHNOLOGY CO., LTD., Dongguan (CN)

(72) Inventors: Congdong Sha, Dongguan (CN); Zhigang Wang, Dongguan (CN); Shichun Zhao, Dongguan (CN); Yuanyuan She, Dongguan (CN); Feng Zhang, Donggukan (CN)

(73) Assignee: DONGGUAN WANTAI ELECTRONICS TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/151,853

(22) Filed: Jan. 19, 2021

(51) Int. Cl.

| | |
|---|---|
| ***H04R 1/10*** | (2006.01) |
| ***H04R 31/00*** | (2006.01) |
| ***H04R 9/04*** | (2006.01) |
| ***H04R 1/02*** | (2006.01) |

(52) U.S. Cl.
CPC ..... *H04R 31/006* (2013.01); *H04R 1/025* (2013.01); *H04R 9/045* (2013.01); *H04R 2420/07* (2013.01)

(58) Field of Classification Search
CPC .. H04R 1/1016; H04R 1/1025; H04R 1/1041; H04R 1/1075; H04R 2420/07; H04R 2420/09; H04R 2460/13
See application file for complete search history.

(56) References Cited

U.S. PATENT DOCUMENTS

2021/0219074 A1* 7/2021 Zhang ..... H04R 25/505

* cited by examiner

*Primary Examiner* — Amir H Etesam
(74) *Attorney, Agent, or Firm* — Law Offices Of Steven W. Weinrieb

(57) ABSTRACT

The present invention provides an internally welded ANC Bluetooth headset speaker, comprising: a U CUP, a magnet, a washer, a tuning net, a pad, a tuning net cloth, a bracket, a voice coil, and a diaphragm, wherein the bracket is sleeved on a top of the U cup, the diaphragm is sleeved on a top of the bracket, the voice coil is provided at a bottom of the diaphragm, and the voice coil is located inside the bracket, the bottom of the bracket is bonded with a tuning net cloth, and the tuning net cloth is located outside the U cup, the magnet is sleeved inside the U cup, the washer is provided on a top of the magnet, the pad is provided on a top of the washer, and the pad is located at a bottom of the voice coil, the tuning net is provided on the top of the washer, and the tuning net is located on one side of the pad. The internally welded ANC Bluetooth headset speaker has a simple structure and easy operation. It adopts an internal welding structure and is more firmly fixed. It can adjust the sound effect, and the sound is concentrated which increases the sound penetration, makes the ears easy to capture, does not spread to the surrounding, avoids interference with others, and is beneficial to users.

3 Claims, 2 Drawing Sheets

INTERNALLY WELDED ANC BLUETOOTH HEADSET SPEAKER

BACKGROUND OF THE INVENTION

Field of the Invention

The present invention relates to the technical field of Bluetooth headset speakers, specifically relates to an internally welded ANC Bluetooth headset speaker.

Background of the Invention

The Bluetooth headset is the application of Bluetooth technology to the hands-free headset, so that users can avoid the annoying wires and talk easily in various ways. The traditional Bluetooth headset speaker adopts a splicing structure, which is not firmly fixed and cannot adjust the sound effect, which causes the sound to be unconcentrated and reduces the sound penetration, and at the same time it is easy to spread around, easily interfere with others, and is not conducive to users. In view of these defects, it is necessary to design an internally welded ANC Bluetooth headset speaker.

OBJECTIVE OF THE INVENTION

The object of the present invention is to provide an internally welded ANC Bluetooth headset speaker to solve the problems raised in the background art.

SUMMARY OF THE INVENTION

In order to solve the above-mentioned technical problems, the present invention provides the following technical solutions: an internally welded ANC Bluetooth headset speaker, comprising: a U CUP, a magnet, a washer, a tuning net, a pad, a tuning net cloth, a bracket, a voice coil, and a diaphragm, wherein the bracket is sleeved on a top of the U cup, the diaphragm is sleeved on a top of the bracket, the voice coil is provided at a bottom of the diaphragm, and the voice coil is located inside the bracket, the bottom of the bracket is bonded with a tuning net cloth, and the tuning net cloth is located outside the U cup, the magnet is sleeved inside the U cup, the washer is provided on a top of the magnet, the pad is provided on a top of the washer, and the pad is located at a bottom of the voice coil, the tuning net is provided on the top of the washer, and the tuning net is located on one side of the pad.

Further, mounting grooves are provided on a center of the bracket, and the mounting grooves are sleeved outside the voice coil.

Further, the bottom of the bracket is bonded with a support frame, and the support frame is located outside the U cup.

Compared with the prior art, the present invention achieves the following beneficial effects: the internally welded ANC Bluetooth headset speaker has a simple structure and easy operation. It adopts an internal welding structure and is more firmly fixed. Sound is produced through the resonance of magnet and washer, the tuning net and the tuning net cloth adjust the sound effect, the voice coil and the diaphragm can produce sound, the sound effect can be adjusted, and the sound is concentrated, thereby increasing the sound penetration, making the ears easy to capture and not spread around to avoid interference with others, which is conducive to the use of users.

BRIEF DESCRIPTIONS OF THE DRAWINGS

The drawings are used to provide a further understanding of the present invention and constitute a part of the specification. Together with the embodiments of the present invention, they are used to explain the present invention, and do not constitute a limitation to the present invention:

Figure 1:
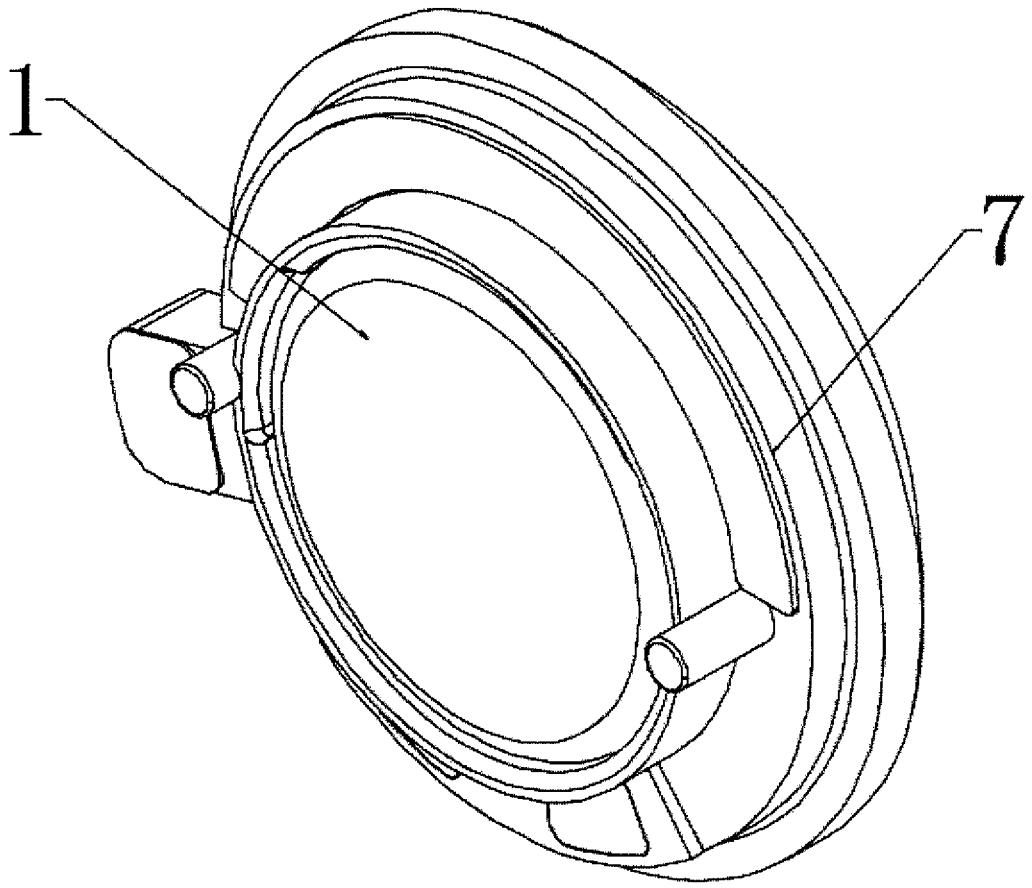
FIG. 1 is a perspective view of the overall structure of the present invention.

Reference numbers in drawings are as follows in sequence:

In the drawings, 1 is a U CUP, 2 is a magnet, 3 is a washer, 4 is a tuning net, 5 is a pad, 6 is a tuning net cloth, 7 is a bracket, 8 is a voice coil, 9 is a diaphragm.

DETAILED DESCRIPTION

The technical solutions in the present invention embodiments will be clearly and completely described below in conjunction with the drawings in the present invention embodiments. Obviously, the described embodiments are only a part of the embodiments of the present invention, rather than all the embodiments. Based on the embodiments in the present invention, all other embodiments obtained by those of ordinary skill in the art without creative work all will fall within the scope of protection of the present invention.

Figure 2:
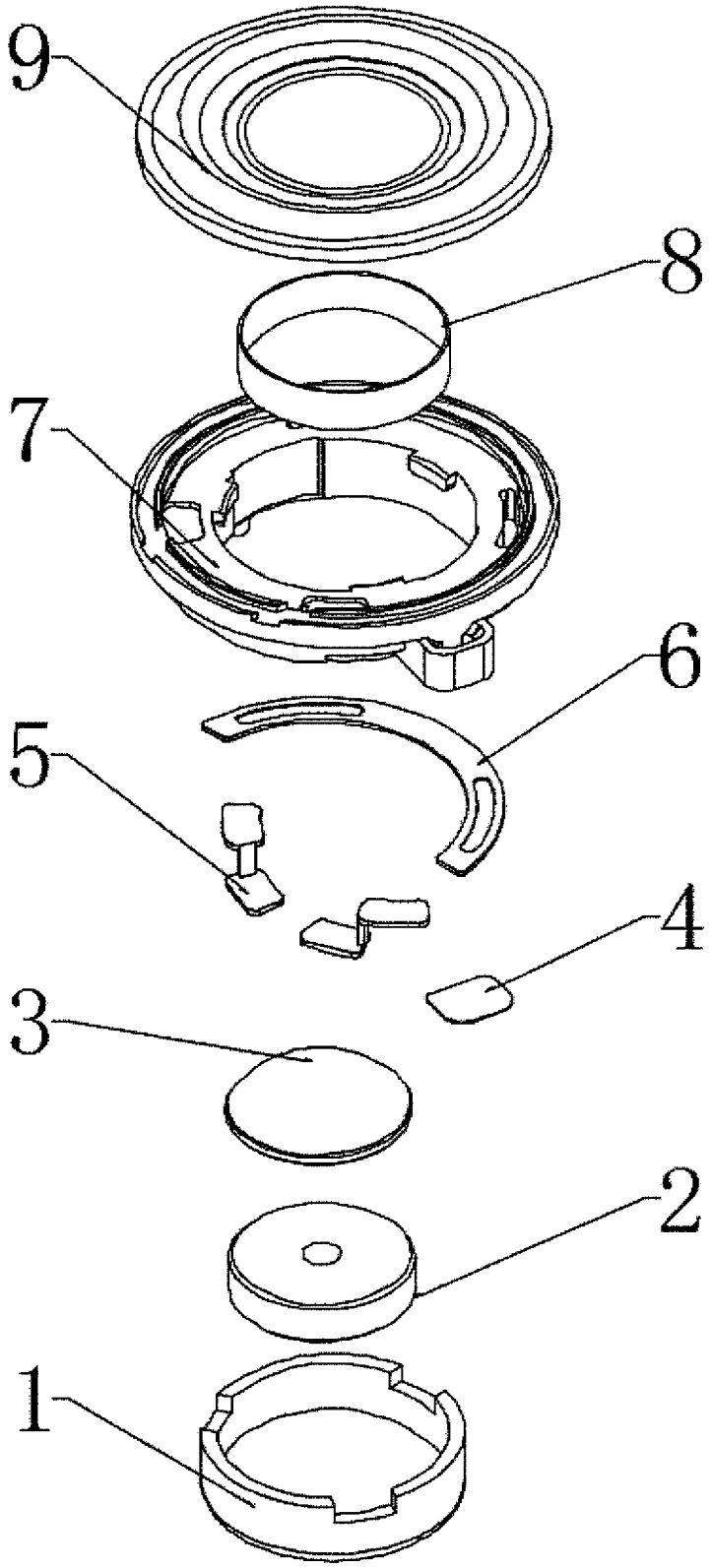
FIG. 2 is an exploded view of the parts of the overall structure of the present invention.

As shown in FIGS. 1 and 2, the present invention provides a technical solution: an internally welded ANC Bluetooth headset speaker, comprising: a U CUP 1, a magnet 2, a washer 3, a tuning net 4, a pad 5, a tuning net cloth 6, a bracket 7, a voice coil 8, and a diaphragm 9, wherein the bracket 7 is sleeved on a top of the U cup 1, the bottom of the bracket 7 is bonded with a support frame, and the support frame is located outside the U cup 1, which is conducive to the support and fixation of bracket 7. The diaphragm 9 is sleeved on a top of the bracket 7, the voice coil 8 is provided at a bottom of the diaphragm 9, and the voice coil 8 is located inside the bracket 7, mounting grooves are provided on a center of the bracket 7, and the mounting grooves are sleeved outside the voice coil 8 to prevent the voice coil 8 from shaking and falling off. The bottom of the bracket 7 is bonded with a tuning net cloth 6, and the tuning net cloth 6 is located outside the U cup 1, the magnet 2 is sleeved inside the U cup 1, the washer 3 is provided on a top of the magnet 2, the pad 5 is provided on a top of the washer 3, and the pad 5 is located at a bottom of the voice coil 8, the tuning net 4 is provided on the top of the washer 3, and the tuning net 4 is located on one side of the pad 5. When the internally welded ANC Bluetooth headset speaker is used, the bracket 7 is manually fixed inside the ANC Bluetooth headset, and the sound is produced through the resonance of magnet 2 and washer 3, and the sound effects are adjusted by the tuning net 4 and the tuning net cloth 6, and voice coil 8 and diaphragm 9 can produce sound.

It should be noted that in this specification, relational terms such as "first" and "second" are only used to distinguish one entity or operation from another entity or operation, and do not necessarily require or imply any such actual relationship or order between these entities or operations. Moreover, the terms "comprising", "including" or any other variations thereof are intended to cover non-exclusive inclusion, so that a process, method, article or device including a series of elements not only includes those elements, but also includes other elements that are not explicitly listed, or also includes elements inherent to such a process, method, article, or device.

Finally, it should be noted that the above is only a preferred embodiment of the present invention, and is not used to limit the present invention, although the present invention is described in detail with reference to the foregoing embodiments, for those skilled in the art, they can still modify the technical solutions described in the foregoing embodiments, or equivalently replace some of the technical features. All modifications, equivalent replacements, improvements, etc. made within the spirit and principles of the present invention shall be included in the scope of protection of the present invention.

What is claimed is:

1. An internally welded ANC Bluetooth™ headset speaker, comprising: a U cup, a magnet, a washer, a tuning net, a pad, a tuning net cloth, a bracket, a voice coil, and a diaphragm, wherein: the bracket is sleeved on a top of the U cup; the diaphragm is sleeved on a top of the bracket; the voice coil is provided at a bottom of the diaphragm, and the voice coil is located inside the bracket; the bottom of the bracket is bonded with a tuning net cloth, and the tuning net cloth is located outside the U cup; the magnet is sleeved inside the U cup; the washer is provided on a top of the magnet; the pad is provided on a top of the washer, and the pad is located at a bottom of the voice coil; and the tuning net is provided on the top of the washer, and the tuning net is located on one side of the pad.

2. The internally welded ANC Bluetooth headset speaker according to claim 1, wherein: mounting grooves are provided upon a center of the bracket, and the mounting grooves are sleeved outside the voice coil.

3. The internally welded ANC Bluetooth headset speaker according to claim 1, wherein: the bottom of the bracket is bonded with a support frame, and the support frame is located outside the U cup.

* * * * *